US007874857B2

(12) United States Patent
Takei et al.

(10) Patent No.: US 7,874,857 B2
(45) Date of Patent: Jan. 25, 2011

(54) CARD CONNECTOR

(75) Inventors: Kazunori Takei, Tokyo (JP); Hitoshi Kikuchi, Tokyo (JP); Hirokazu Takahashi, Tokyo (JP); Hiromichi Kato, Tokyo (JP)

(73) Assignee: DDK Ltd., Tokyo (JP)

( * ) Notice: Subject to any disclaimer, the term of this patent is extended or adjusted under 35 U.S.C. 154(b) by 177 days.

(21) Appl. No.: 12/321,732

(22) Filed: Jan. 23, 2009

(65) Prior Publication Data

US 2010/0190365 A1 Jul. 29, 2010

(51) Int. Cl.
*H01R 24/00* (2006.01)

(52) U.S. Cl. ..... 439/218; 439/630

(58) Field of Classification Search ..... 439/218, 439/630, 633

See application file for complete search history.

(56) References Cited

U.S. PATENT DOCUMENTS

| | | | | |
|---|---|---|---|---|
| 4,957,831 | A * | 9/1990 | Meredith et al. | 429/121 |
| 5,442,514 | A * | 8/1995 | Hopkins | 361/679.39 |
| 5,545,046 | A * | 8/1996 | Masuda et al. | 439/142 |
| 5,701,232 | A * | 12/1997 | Tang et al. | 361/679.58 |
| 5,755,821 | A * | 5/1998 | Ngai et al. | 439/138 |
| 5,793,352 | A * | 8/1998 | Greenberg et al. | 345/699 |
| 6,666,724 | B1 * | 12/2003 | Lwee | 439/630 |
| 6,672,904 | B1 * | 1/2004 | Chen | 439/631 |
| 6,869,017 | B2 * | 3/2005 | Yamaguchi | 235/483 |
| 6,974,350 | B1 * | 12/2005 | Chen | 439/630 |
| 7,108,558 | B2 * | 9/2006 | Zhu et al. | 439/630 |
| 7,258,578 | B2 * | 8/2007 | Kikuchi et al. | 439/630 |
| 7,357,653 | B2 * | 4/2008 | Hung et al. | 439/138 |
| 7,389,936 | B2 * | 6/2008 | Hug et al. | 235/486 |
| 7,466,555 | B2 * | 12/2008 | Yamamoto | 361/737 |
| 7,494,380 | B2 * | 2/2009 | Lai | 439/630 |
| 7,612,993 | B1 * | 11/2009 | Takei et al. | 361/679.31 |
| 7,744,421 | B2 * | 6/2010 | Harada | 439/630 |
| 2006/0025019 | A1 | 2/2006 | Zhu et al. | |
| 2007/0218770 | A1 * | 9/2007 | Kikuchi et al. | 439/630 |

FOREIGN PATENT DOCUMENTS

| | | |
|---|---|---|
| JP | 2005-340141 | 12/2005 |
| JP | 2006-120482 | 5/2006 |
| JP | 2007-250324 | 9/2007 |

* cited by examiner

*Primary Examiner*—Neil Abrams
(74) *Attorney, Agent, or Firm*—Abelman, Frayne & Schwab

(57) ABSTRACT

A card connector for a plurality of memory cards includes a housing having a plurality of inserting holes for the memory cards, respectively. The card connector includes a swing member made of an elastic metal plate and having fixing portions and a swing part in the form of a hollow square rod having extending portions extending into the inserting holes when the swing member is fixed in the housing. A partition wall between the inserting holes is formed with a rectangular notch and slits in opposite faces of the rectangular notch for press-fitting the fixing portions of the swing member, respectively. When one memory card is inserted into one inserting hole, the inserted memory card causes the swing part to be further extended into another inserting hole, thereby preventing another memory card from being inserted into the another inserting hole.

5 Claims, 5 Drawing Sheets

CARD CONNECTOR

BACKGROUND OF THE INVENTION

This invention relates to a card connector for use in various electric and electronic appliances such as printers, card readers and the like for inputting and outputting signals into and from memory cards of a plurality of kinds inserted into the card connector, and more particularly to a card connector having a structure permitting one memory card only to be inserted at a time.

In recent years, with the widespread use of digital cameras and the like, memory cards having a large storage capacity and a compact shape have been used. A wide variety of cards have been used depending upon characteristics and the like of appliances with which the memory cards are used, and therefore card connectors adapted to accommodate cards of a plurality of kinds will be favorable. With such card connectors adapted to receive the cards of different kinds, however, it will be required to prevent a plurality of cards from being inserted into a card connector at a time.

Many card connectors have been proposed, which may enable cards of a plurality of kinds to be received and prevent a further card from being inserted into a card connector when a first card has been inserted therein.

As examples of such card connectors, incorporated herein are United States Patent Application Publication No. 2006/0025019 A1 (Patent Literature 1), and as those proposed by the applicant of the patent application, Japanese Patent Application Opened No. 2005-340141 (Patent Literature 2), Japanese Patent Application Opened No. 2006-120,482 (Patent Literature 3),and Japanese Patent Application Opened No. 2007-250,324 (Patent Literature 4).

Patent Literature 1

The card connector according to the United States Patent Application Publication No. 2006/0025019 A1 comprises an insulating housing 1 defining adjacent card cavities 11, 12, 13 and 14; a plurality of card contacts 2, 3, 4 and 5 retained in the housing to expose to the corresponding card cavities; and at least one controlling member 6 or 7 disposed in the housing between the two card cavities, and comprising upper and lower protrusions 62 and 63 deflected between the two card cavities and protruding into the one card cavity when a card has been inserted into the other card cavity, and a resilient portion 61 for urging the upper and lower protrusions to resume their original positions when the card has been withdrawn from the other cavity.

Patent Literature 2

The card connector removably receiving a plurality of memory cards disclosed in the Japanese Patent Application Opened No. 2005-340141, includes a required number of contacts 13 adapted to contact connecting portions of the memory cards 45, and a housing 12 arranging and holding the contacts 13 therein and having a plurality of inserting openings 23 into which the plurality of memory cards 45 are inserted, respectively, wherein the housing 12 is provided at predetermined positions with at least one locking member 20 movable or pivotally movable when a memory card is inserted and with at least one spring member 18 displaceable when the memory card is inserted, thereby enabling one memory card only to be inserted when another memory card has been inserted with the aid of the locking member 20 and the spring member 18.

Patent Literature 3

The card connector into which a plurality of memory cards 50 are removably inserted, disclosed in Japanese Patent Application Opened No. 2006-120,482 includes a plurality of contacts 14 adapted to contact connection portions of the plurality of the memory cards 50, and a housing 12 arranging and holding the contacts 14 therein and having a plurality of inserting openings 22 into which the plurality of memory cards are inserted, respectively, wherein the card connector comprises a required number of sliders 20 arranged at predetermined positions in the housing 12 for forming parts of the plurality of inserting openings, and a required number of holders 18 arranged at predetermined positions in the housing for movably holding the sliders 20, thereby preventing more than one memory card from being inserted into the card connector by means of the sliders 20 at a time.

Patent Literature 4

The card connector into which a plurality of memory cards are removably inserted, and removed disclosed in Japanese Patent Application Opened No. 2007-250,324 includes contact 14 and 16 of two kinds for the two memory cards 501 and 502, respectively each adapted to contact a connection portion of the memory card, and a housing 12 having two inserting openings 221 and 222 each into which the respective memory card is inserted and arranging and holding the contacts, wherein the two inserting openings 221 and 222 provided in the housing are arranged one above the other substantially in parallel relationship, and one above the other substantially in parallel relationship, and an insertion preventing member 20 is arranged in a position between the inserting openings so as not to contact the contacts of two kinds so that once either of the memory cards has been inserted, the other memory card is prevented from being inserted by means of the insertion-preventing member.

In the Patent Literature 1 (United States Patent Application Publication No. 2006/0025019), first and second resilient members 6 and 7 serve to prevent a plurality of cards from being inserted at a time. Now, the first resilient member 6 will be considered because the second resilient member 7 is similar in operation to the first resilient member 6. The first resilient member 6 formed from a sheet metal comprises a securing portion 60, a resilient portion 61, and a first stopper having an upper protrusions 62 and a lower protrusion 63. The securing portion 60 is secured in a locking slot 1022 formed in the housing, and the first stopper having the upper and lower protrusions 62 and 63 is disposed in a groove 1021 formed in the housing. When a CF card is inserted into CF card cavity 11, the CF card engages and pushes the upper protrusion 62 downwardly along the groove 1021 with the aid of elastic deformation of the resilient portion 61. As a result of this, the lower protrusion 63 extends into the SD/MMC card cavity 12, the MS card cavity 13 and the XD card cavity 14. In this case, the prevention of the insertion of other memory cards relies upon the elastic deformation of the resilient member 6. Therefore, the prevention of the insertion of the other cards would lack accuracy and reliability. The installation of the resilient member 6 in the locking slot 1022 and groove 1021 formed in the housing would have a risk of dislodgment of the resilient member from the card connector over time and would increase the number of producing steps to increase a production cost.

In the Patent Literature 2 (Japanese Patent Application Opened No. 2005-340,141), the locking member 20 is substantially in the form of a triangular plate whose one vertex is pivotally mounted in the housing 12. When a memory card 45 is inserted into either of inserting holes 23 arranged side by side in the lower stage of the connector, the memory card 45 pushes one vertex 34 of the locking member 20 so as to cause the other vertex 34 to extend into the remaining inserting hole 23, thereby preventing a memory card from being inserted into the remaining inserting hole 23. The spring member 18 made of a metal includes a fixed portion 29 to be fixed to the housing 12, an elastic portion 28 and two extending portions 30 extending in both width directions. The spring member 18 is inserted into and fixed to the housing 12 such that the elastic portion 28 of the spring member 18 extends into the inserting hole 23 in the upper stage of the connector. When a memory card 45 is inserted into the inserting hole 23 in the upper stage of the housing 12, the memory card 45 pushes the elastic portion 28 of the spring member 18 downward to cause the two extending portions 30 of the spring member 18 to extend into the inserting holes 23 in the lower stage of the connector, thereby preventing a memory card 45 from being inserted into the inserting holes 23 in the lower stage after a memory card has been inserted into the inserting hole in the upper stage. The idea using an elastic member for preventing a memory card from being inserted is substantially similar to that in the Patent Literature 1 so that this construction would be devoid of accuracy and reliability and further there would be a tendency for the spring member 18 to be dislodged. Moreover, the operation for mounting the locking member 20 in the housing in a pivotally movable manner is complicated to increase the number of producing steps to increase a production cost.

In the Patent Literature 3 (the Japanese Patent Application Opened No. 2006-120,482), the slider 20 is substantially rectangular and is formed from a plastic material but may be from a metal. The slider 20 comprises recesses 30, a protrusion 32, and a elongated inserting aperture 28 into which the holder in the directions of the thickness of the connector. The four recesses 30 form parts of inserting openings 221, 223, 224 and 225 arranged side by side and one above the other, and one protrusion 32 forms part of an inserting opening 222 arranged below and at an intermediate position of the four inserting openings. When a memory card is inserted into one inserting opening, this memory card is also simultaneously inserted into one of the recess corresponding to the inserting opening and moves the slider in the vertical direction so that the other recesses and the protrusion extend into the other inserting openings, thereby preventing another memory card from being inserted into the remaining inserting openings. Although this construction has an advantage for accommodating many kinds of memory cards, the construction would be complicated to increase its manufacturing cost, and would experience deterioration and failure over time.

In the Patent Literature 4 (the Japanese Patent Application Opened No. 2007-250,324), the insertion-preventing member 20 serves to prevent a further memory card from being inserted into the card connector after a memory card has been inserted. The insertion-preventing member 20 is made of a metal or a plastic material and comprises a holding portion 28 for holding the member 20 in the housing 12, an elastic portion 32, and an upper projection 301 and a lower projection 302. When one memory card 50 is inserted into one inserting opening 22, the projection 301 or 302 is pushed downwardly or upwardly by the memory card 50 so that the elastic portion 32 of the member 20 is deformed downwardly or upwardly, with the result that projection 302 or 301 is extend into the other inserting opening 22, In this way, a further memory card cannot be inserted and hence only one memory card 50 is permitted to be inserted. Although the card connector achieves its purpose with the simple construction, the function of the insertion-preventing member 20 is limited to the case having only two inserting openings for memory cards one above other.

SUMMARY OF THE INVENTION

In view of the problems of the prior arts described above, the invention has been completed and has an object to provide a card connector which accommodates two or more memory cards of different kinds and reliably operates with a high accuracy and which is particularly simple and inexpensive to manufacture, easy to install a key part of a insertion-preventing member, and rugged and durable in use.

The object of the invention described above can be achieved by the card connector 16 into and from which a plurality of memory cards are detachably inserted and removed, including a required number of contacts 18 and 19 adapted to contact connection portions of said memory cards, a housing 12 arranging and holding said contacts 18 and 19 and having a plurality of inserting holes 2 and 3 arranged in vertically overlapping relationship for inserting said memory cards, respectively, said card connector comprising a swing member 6 including fixing portions 9 on its both sides to be fixed in said housing 12, and a swing part 8 having extending portions extending into said inserting holes 2 and 3 when the swing member 6 is fixed in said housing 12, said swing part 8 having an elastic quality so that the memory card inserted in one inserting hole 2 or 3 causes said swing part 8 to be swung into the other inserting hole 3 or 2, and a slit member 1 in the form of a plate arranged in said housing 12 between the two inserting holes 2 and 3 and having a notch 5 extending substantially in the inserting direction of the memory cards and having a size enabling said swing part 8 to be accommodated so as to permit said swing part 8 to be swung into said inserting holes, and said slit member 1 being formed with slits 4 in opposite faces of said notch 5 for press-fitting said fixing portions 9 of said swing member 6, respectively, whereby when one memory card is inserted into one inserting hole 2 or 3, the inserted memory card causes said swing part 8 to be further extended into anther inserting hole 3 or 2, thereby preventing another memory card from being inserted into the another inserting hole 3 or 2.

In one preferred embodiment, a partition wall between said inserting holes 2 and 3 of the housing 12 is directly formed with said notch 5 and said slits 4, thereby forming said slit member 1 by said partition wall.

Preferably, said swing member 6 is formed from a thin metal having an elastic quality and comprises a main part 11, said fixing portions 9 on both sides thereof, and said swing part 8 in the form of a hollow square rod so that an inserted memory card abuts against an inclined surface of said square rod to facilitate the swinging of the swing part 8.

In a preferred embodiment, said swing member 6 is formed with two slits 11 on inner sides of said fixing portions 9 so that the swing part 8 extends longer from the main part 11 in a cantilevered manner, thereby further facilitating the swinging of the swing part 8.

If required, either or both of said inserting holes are constructed so as to accommodate memory cards of plural kinds. In such a case, the invention is applicable to memory cards of more than two kinds.

The card connector according to the invention brings about the following significant functions and effects.

(1) The card connector 16 according to the invention is simple in construction to permit only one memory card to be inserted at a time and hence eliminates any errors in integrated circuits for controlling the memory cards with a high accuracy and a high reliability.

(2) The card connector 16 according to the invention employs the swing member 6 for preventing a memory card from being inserted into the card connector after one memory card has been inserted. The swing member 6 can be formed in a simple manner by thin plate-working such as punching, shearing, bending and the like and its installation in the housing 12 can be achieved by merely inserting the fixing portions 9 into the slits 4 formed in the slit member 1 or a partition wall of the housing 12. Therefore, the swing member itself 6 and its installation in the housing 12 are simpler and more economical in comparison with means used in the Patent Literatures 1 to 4 for preventing two memory cards from being inserted at a time. Accordingly, the swing member 6 and its installation into the housing 12 are so simplified and achieved with great certainty and with less steps of production process which contribute to the inexpensive production.

(3) According to the invention, once the fixing portions 9 of the swing member 6 are forcedly fitted in the slits 4 of the slit member 1, the direction in which the swing member 6 is subjected to the inserting force of a memory card coincides with the direction in which the swing member 6 is pushed into the slits in order to fix the swing member 6 into the housing 12. Accordingly, the swing member 6 becomes even more securely fixed in the housing 12 over time so that there will be little, if any, dislodgement of the swing member 6 from the card connector. Therefore, the card connector 16 according to the invention is reliable and ragged and durable in use.

The invention will be more fully understood by referring to the following detailed specification and claims taken in connection with the appended drawings.

DESCRIPTION OF THE PREFERRED EMBODIMENTS

Figure 1A:
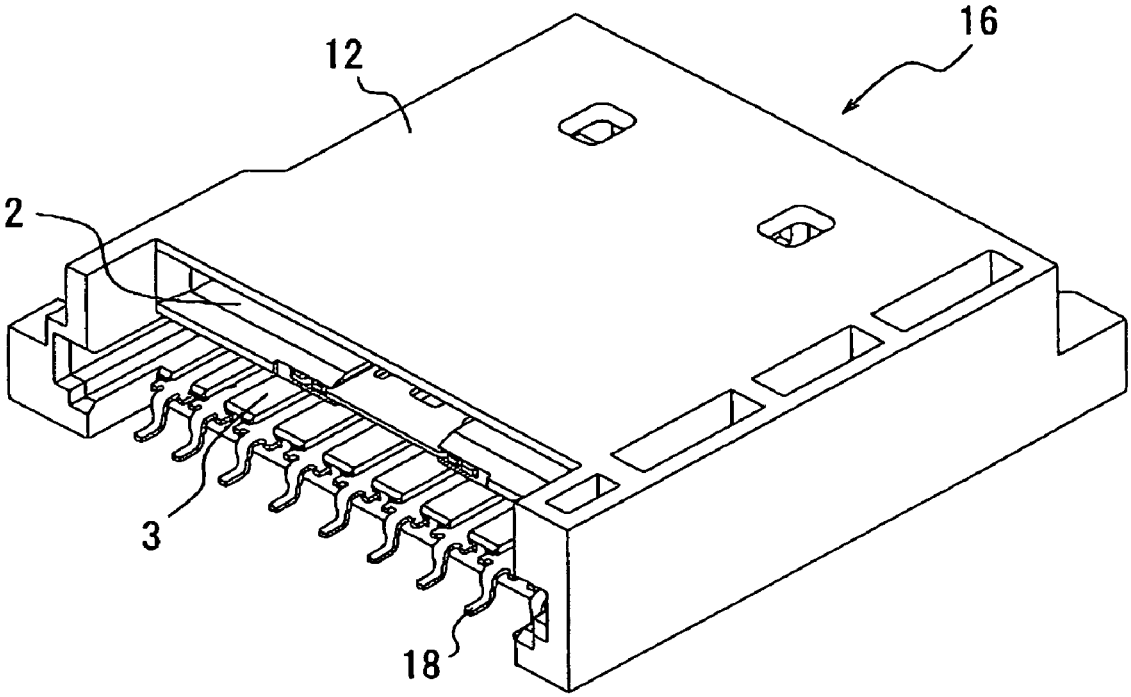
FIG. 1A is a perspective view of the card connector according to one embodiment of the invention viewed from the side of openings of inserting holes.
Figure 1B:
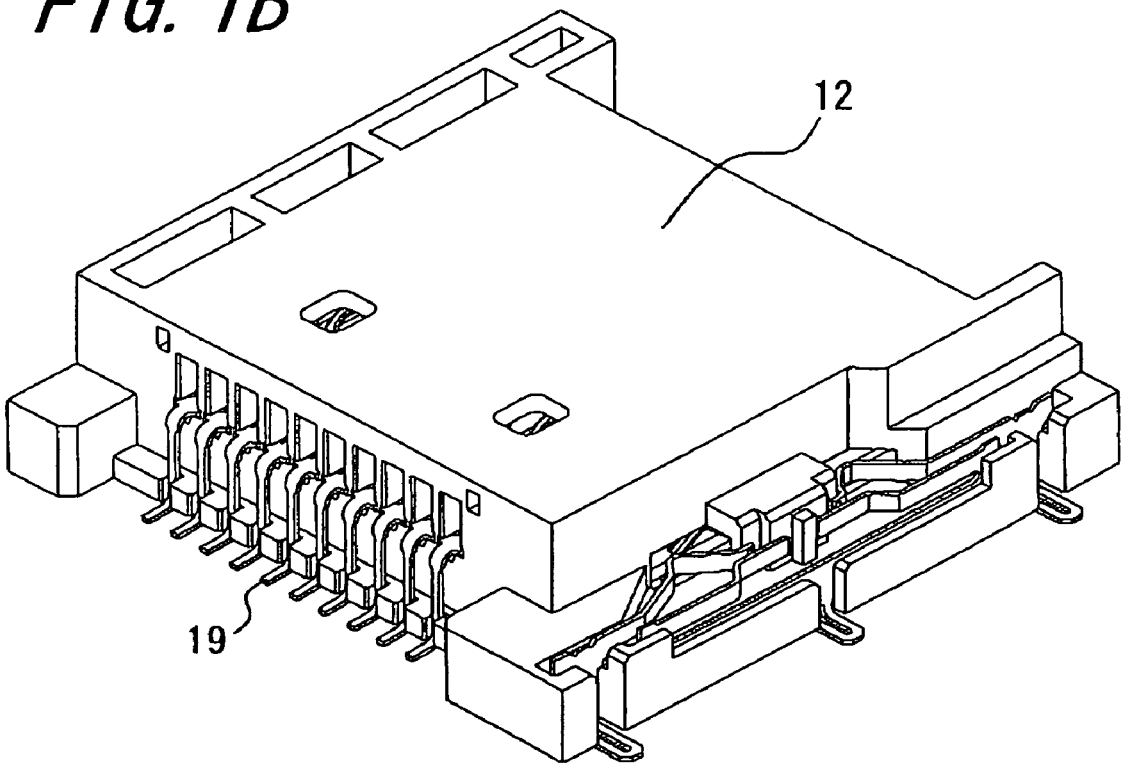
FIG. 1B is a perspective view of the card connector shown in FIG. 1A viewed from the opposite side of the openings of the inserting holes.
Figure 2:
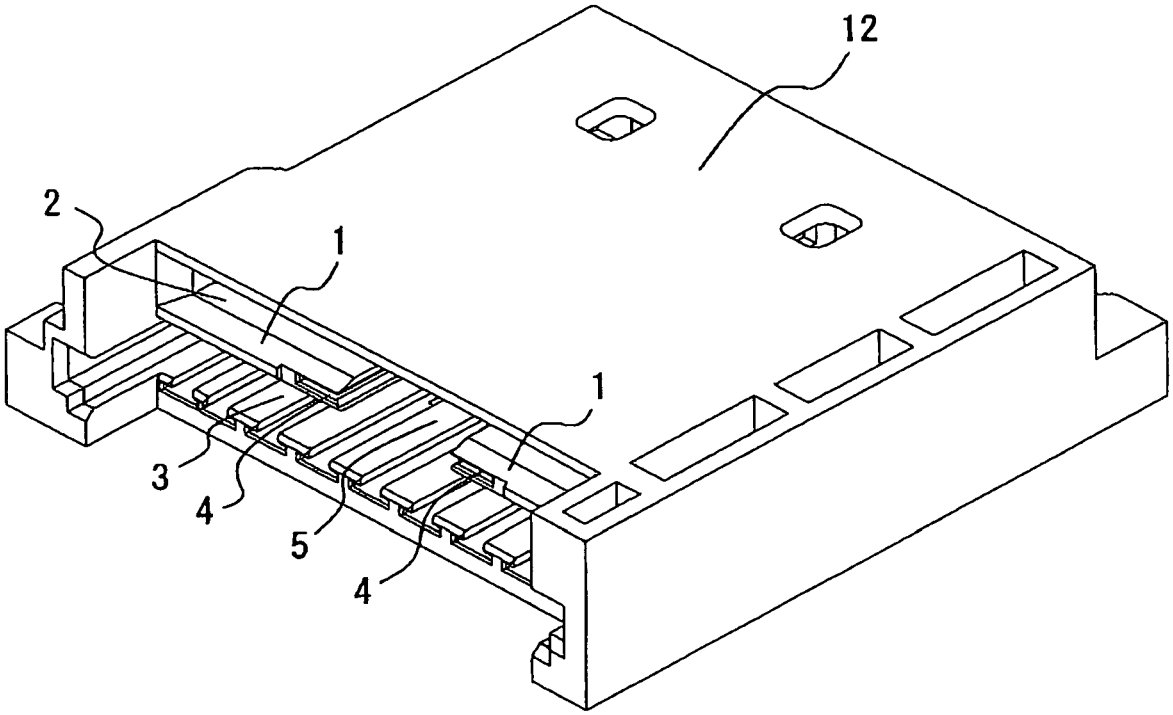
FIG. 2 is a perspective view of the housing of the card connector viewed from the side of the openings of the inserting holes.

One preferred embodiment of the card connector according to the invention will be explained hereinafter with reference to FIGS. 1A to 6.

The card connector 16 according to the invention mainly comprises a number of contacts 18 and 19 adapted to contact connection portions of memory cards, a housing 12 holding the contacts 18 and 19 and having inserting holes 2 and 3 for inserting the memory cards, and a swing member 6 and a slit member 1 which are the subject matters of the invention.

Figure 3:
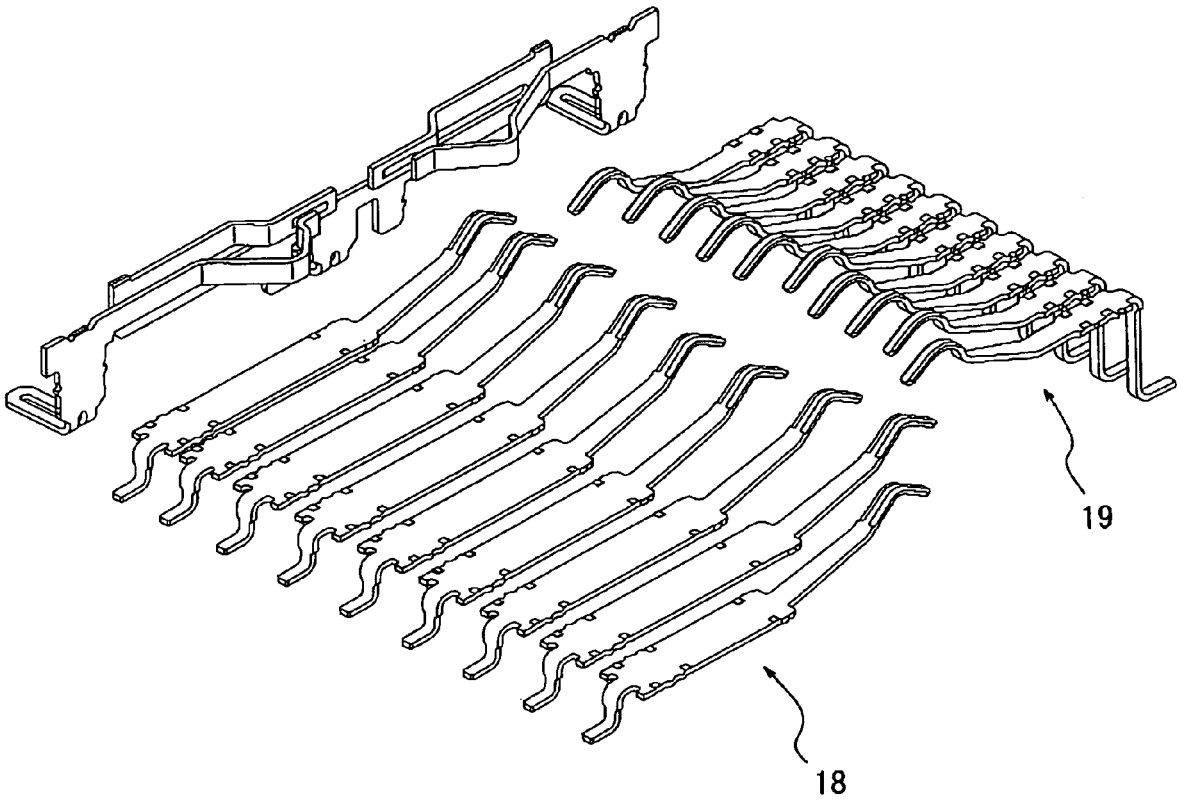
FIG. 3 is a perspective view of contacts used in the card connector.

The contacts of the card connector 16 are two kinds of contacts 18 and 19 in the illustrated embodiment as shown in FIG. 3. The contacts 18 and 19 will not be described in further detail since they are not essential for an understanding of the invention.

Figure 4:
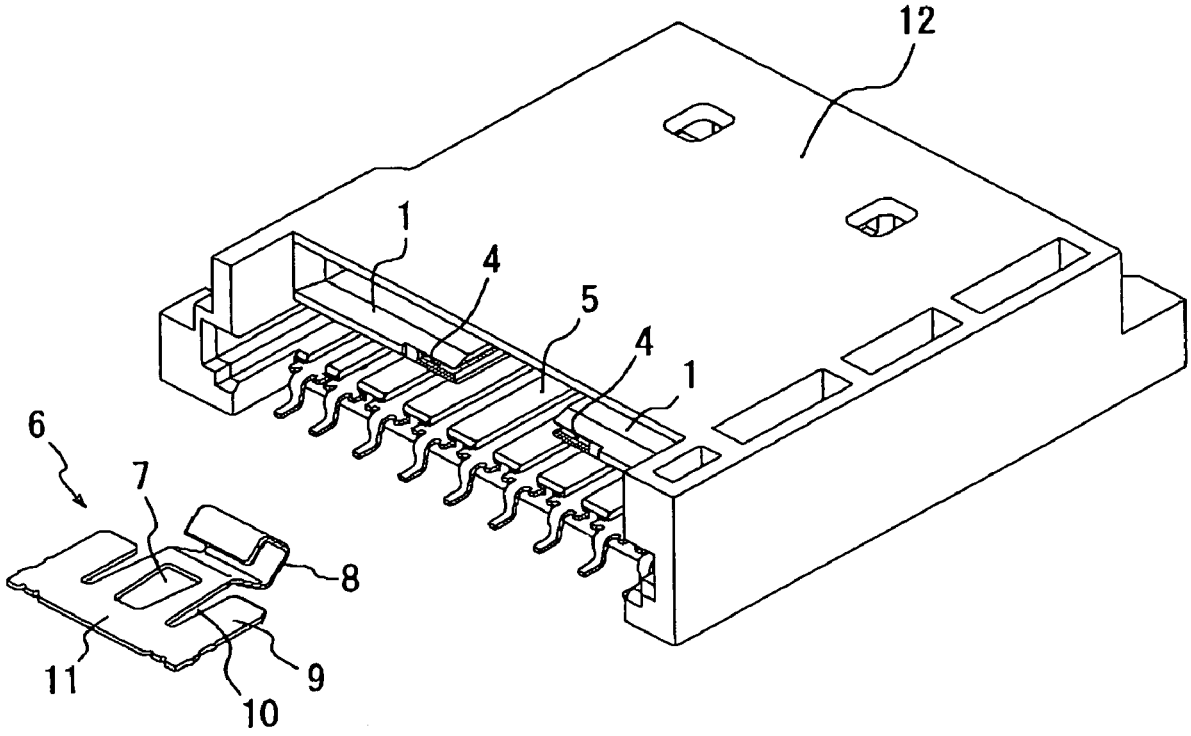
FIG. 4 is a perspective view of the card connector and the swing member before being inserted thereinto.
Figure 5:
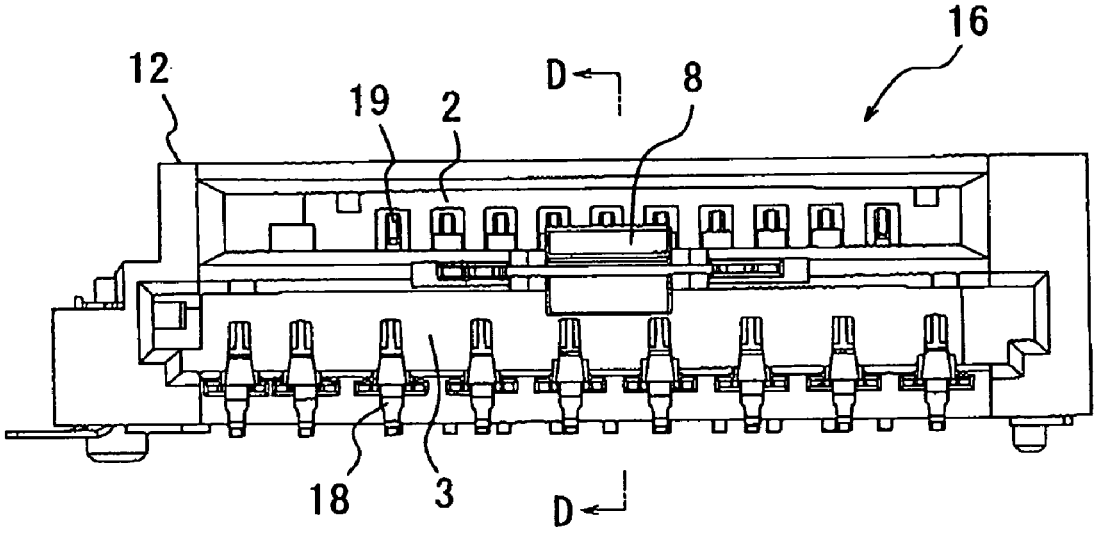
FIG. 5 is a front view of the card connector.
Figure 6:
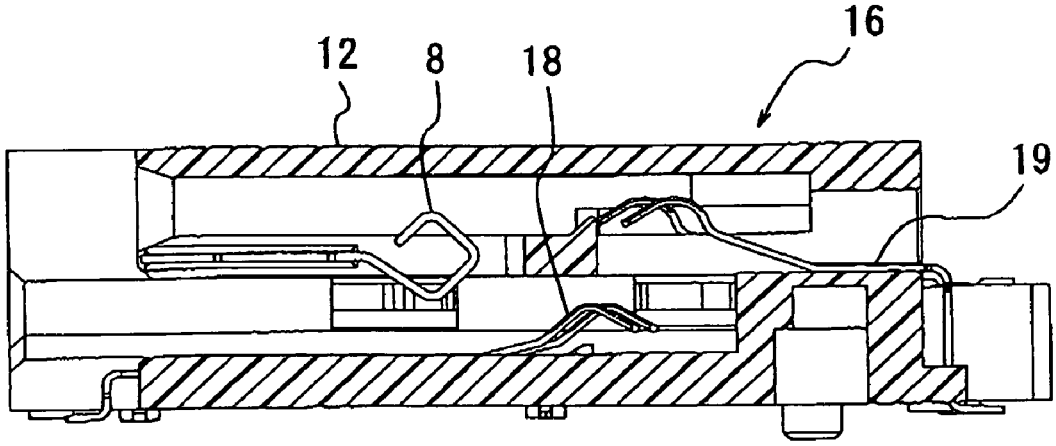
FIG. 6 is a cross-sectional view of the card connector taken along a plane D-D in FIG. 5.

The swing member 6 will be explained with reference to FIG. 4. The swing member 6 is installed and fixed to the housing 12, and thereafter one memory card has been inserted into either of the inserting holes, the swing member 6 serves to prevent another memory card from being inserted into the remaining inserting hole. Such operations of the swing member 6 will be explained in detail after the housing 12 holding the swing member 6 has been explained.

The swing member 6 is made of a sheet metal having a high elastic quality, which may be selected from springy metals. Preferred metals from which to form the swing member 6 include brass, beryllium copper, phosphor bronze and the like which comply with the requirements as to dimensional stability, workability, springiness, and the like. An electrically insulating plastic material may be used for the swing member 6 insofar as it fulfills functions described below. In this case, the plastic materials suitable for the housing 12 described later may be used for the swing member 6. The swing member 6 is formed from such a thin springy metal by thin plate-working such as punching, shearing, bending and the like of the known technique. The swing member 6 comprises a main part 11, fixing portions 9 on both sides which are fixed to the housing 12, and a swing part 8 adapted to be pushed by a memory card inserted into one inserting hole 2 or 3 so as to be swung into another inserting hole 3 or 2, thereby preventing another memory card from being inserted into the another inserting hole 3 or 2.

The fixing portions 9 need only be easily inserted into slots (later described) formed in the housing 12 and be securely fixed therein. The swing part 8 is shaped by bending into a hollow square rod extending substantially horizontally as shown in FIG. 4 whose upper and lower ridges extend into upper and lower inserting holes 2 and 3 when the swing member 6 is fixed in the housing 12 so that a memory card inserted into one inserting hole 2 or 3 pushes the swing part 8 into the other inserting hole 3 or 2. Therefore, the swing part 8 needs to have a sufficient springiness. For this purpose, the main part 11 of the swing member 6 is formed with two slits 10 adjacent to and on inner sides of the fixing portions 9 so that the swing part 8 extends longer from the main part 11 in a cantilevered manner, thereby increasing its springiness. If required, the part of the main part 11 between the two slits 10 may be formed with an aperture 7, thereby further facilitating the deformation of the swing part 8. Moreover, the swing part 8 must be formed so as not to scratch or damage a memory card when it abuts against and pushes the swing part 8 away from the inserting direction of the memory card and slides on the swing part 8 into the final position. Therefore, the ridges of the hollow square rod of the swing part 8 may be rounded, and the flat surfaces together with the edges of the swing part 8 may be smoothly finished.

The housing 12 will then be explained. The housing 12 is formed from an electrically insulating plastic material by means of the injection molding of the known technique. The materials for the housing 12 may be suitably selected in consideration of dimensional stability, workability, manufacturing cost, and the like and in general include polybutylene terephthalate (PBT), polyamide (66PA or 46PA), liquid crystal polymer (LCP), polycarbonate (PC) and the like and combination thereof. The housing 12 is formed with inserting apertures for inserting and holding the contacts 18 and 19 therein, respectively, and an upper inserting hole 2 having an inserting opening for a memory card of one kind and a lower inserting hole 3 having an inserting opening for another memory card of the other kind. The housing 12 is provided with a slit member 1 as means for installing the swing member 6 between the upper and lower inserting holes 2 and 3. In the illustrated embodiment, the slit member 1 corresponds to a partition wall forming a boundary between the upper and lower inserting holes 2 and 3. In more detail, the partition wall is formed at its center with a rectangular notch 5 passing through its thickness and starting from the inserting openings of the inserting holes 2 and 3 and extending a part of the way in the inserting direction of the memory card such that the swing part 8 of the swing member 6 in the rectangular notch 5 is freely swung into the upper and lower inserting holes 2 and 3. The partition wall formed with the rectangular notch 5 is further formed with slits 4 in opposite faces of the rectangular notch 5 for press-fitting the fixing portions 9 of the swing member 6 whose swing part 8 is located on the inner side of the housing 12. The width of the slits 4 corresponding to the thickness of the fixing portions 9 of the swing member 6 may be suitably designed so that the fixing portions 9 of the swing member 6 are forcedly fitted and securely fixed into the slits 4. In the illustrated embodiment, the partition wall itself serves as a slit member 1 for securely holding the swing member 6 between the two inserting holes 2 and 3.

The operation of the swing member thus installed in the housing will be explained. Under the condition that there is no memory card inserted, the upper and lower portions of the swing part 8 in the form of the hollow square rod of the swing member 6 slightly extend into the upper and lower inserting holes 2 and 3 of the housing 12. When a memory card is inserted into the upper inserting hole 2, the memory card abuts against the inclined surface of the swing part 8 in the form of the hollow square rod of the swing member 6 and pushes the swing part 8 toward into the lower inserting hole 3 so that the memory card goes into its final position in the card connector 16. Therefore, the swing part 8 greatly extends in the lower inserting hole 3 and is enforced in the position by the memory card inserted in the upper inserting hole 2.

Under such a condition that one memory card has been inserted into the upper inserting hole 2 of the card connector 16, if another memory card is inserted into the lower inserting hole 3 which has no memory card, the another memory card being inserted will collide with the swing part 8 which is greatly extending in the lower inserting hole 3 and enforced in its position by the memory card inserted in the upper inserting hole 2. Therefore, the swing part 8 extending in the lower inserting hole 3 provides a reliable impediment to another memory card so that any memory card cannot be inserted into the lower inserting hole 3. In the same way, in case that initially a memory is inserted in the lower inserting hole 3, it is apparent that another memory card can also be prevented from being inserted into the upper inserting hole 2.

Although the card connector for two kinds of memory cards is shown and described in the embodiment, it is to be understood that if a card connector is constructed so as to enable memory cards of plural kinds to be inserted into either or both inserting holes as known by those skilled in the art, the invention is applicable to memory cards of more than two kinds.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A card connector into and from which a plurality of memory cards are detachably inserted and removed, including a required number of contacts adapted to contact connection portions of said memory cards, a housing arranging and holding said contacts and having a plurality of inserting holes arranged in vertically overlapping relationship for inserting said memory cards, respectively, said card connector comprising:

a swing member including fixing portions on its both sides to be fixed in said housing, and a swing part having extending portions extending into said inserting holes when the swing member is fixed in said housing, said swing part having an elastic quality so that the memory card inserted in one inserting hole causes said swing part to be swung into the other inserting hole, and a slit member in the form of a plate arranged in said housing between the two inserting holes and having a notch extending substantially in the inserting direction of the memory cards and having a size enabling said swing member except for said fixing portions to be accommodated so as to permit said swing part to be swung into said inserting holes, and said slit member being formed with slits in opposite faces of said notch for press-fitting said fixing portions of said swing member, respectively, whereby when one memory card is inserted into one inserting hole, the inserted memory card causes said swing part to be further extended into another inserting hole, thereby preventing another memory card from being inserted into the another inserting hole.

2. The card connector as claimed in claim 1, wherein a partition wall between said inserting holes of the housing is directly formed with said notch and said slits, thereby forming said slit member by said partition wall.

3. The card connector as claimed in claim 1, wherein said swing member is formed from a thin metal having an elastic quality and comprises a main part, said fixing portions on both sides thereof, and said swing part in the form of a hollow square rod so that an inserted memory card abuts against an inclined surface of said square rod to facilitate the swinging of the swing part.

4. The card connector as claimed in claim 3 wherein said swing member is formed with two slits on inner sides of said fixing portions so that the swing part extends longer from the main part in a cantilevered manner, thereby further facilitating the swinging of the swing part.

5. The card connector as claimed in claim 1, wherein either or both of said inserting holes are constructed so as to accommodate memory cards of plural kinds.

* * * * *